US006904843B2

(12) United States Patent
Knobel

(10) Patent No.: US 6,904,843 B2
(45) Date of Patent: Jun. 14, 2005

(54) JAM RESISTANT PRINTER BEZEL

(75) Inventor: Larry Knobel, Homer, NY (US)

(73) Assignee: TransAct Technologies Incorporated, Wallingford, CT (US)

( * ) Notice: Subject to any disclaimer, the term of this patent is extended or adjusted under 35 U.S.C. 154(b) by 60 days.

(21) Appl. No.: 10/394,439

(22) Filed: Mar. 20, 2003

(65) Prior Publication Data

US 2004/0184861 A1 Sep. 23, 2004

(51) Int. Cl.[7] ..... B41J 11/00

(52) U.S. Cl. ..... 101/228; 400/625; 400/642; 400/693; 271/226; 271/293; 902/14; 902/18; 902/30

(58) Field of Search ..... 101/228, 232; 400/625, 642, 646, 691, 693; 271/293, 226; 902/8, 14, 18, 23, 30

(56) References Cited

U.S. PATENT DOCUMENTS 5,215,393 A 6/1993 Wincent
5,642,922 A * 7/1997 Ramachandran et al. .... 312/7.2
5,734,404 A * 3/1998 Komuro et al. ..... 347/104
6,575,090 B1 * 6/2003 Vienneau et al. ..... 101/66
6,602,008 B2 * 8/2003 Yamagishi et al. ..... 400/619
6,615,763 B2 * 9/2003 Edwards ..... 118/46

* cited by examiner

*Primary Examiner*—Andrew H. Hirshfeld
*Assistant Examiner*—Kevin D. Williams
(74) *Attorney, Agent, or Firm*—Barry R. Lipsitz; Douglas M. McAllister

(57) ABSTRACT

An anti-jam bezel is provided for dispensing a flexible substrate from an output slot. The output slot has a front portion for outputting the flexible substrate and a rear portion for receiving the flexible substrate from a transport. A guideway diverges away from the rear portion of the output slot toward the transport to provide a substrate receiving opening. When in use, the bezel body is mounted adjacent the transport with a cavity between the transport and the rear portion of the output slot. The guideway is adapted to catch a leading edge of the substrate exiting the transport, and guide the leading edge to the output slot. In the event the output slot is blocked, the guideway will guide at least a portion of the substrate into the cavity, thereby preventing a jam.

21 Claims, 4 Drawing Sheets

JAM RESISTANT PRINTER BEZEL

FIELD OF THE INVENTION

This invention relates to a jam resistant bezel from which paper slips such as tickets, vouchers, coupons and the like are dispensed from a vending machine or similar apparatus. The invention is particularly useful, e.g., in connection with printers for gaming and lottery terminals that provide race-track tickets, lottery tickets, cashless betting slips and the like to consumers.

BACKGROUND OF THE INVENTION

High speed printers, such as inkjet, thermal, dye sublimation and dot matrix printers are used to provide vouchers, coupons, tickets, receipts and the like (hereinafter generically referred to as "slips") to consumers. Such slips are usually made of paper, onto which text and/or graphics are printed, but may alternatively be made of other materials such as cardstock, plastic (e.g., cellophane or Mylar), laminates, metal foil, etc., as long as the material can be fed through the printer transport mechanism. Typically, the slips are discharged to the consumer after printing via a bezel mounted in the front panel of a self-service terminal. Such terminals can be found, for example, in casinos (e.g., slot machines), retail establishments (e.g., lottery machines), transportation centers (e.g., train, bus and subway ticket machines), gasoline service stations (pump receipts), and the like.

One problem that sometimes arises when dispensing slips to consumers is that the bezel becomes blocked. This can occur either accidentally (e.g., by an impatient consumer placing a finger over the bezel output opening while waiting for the slip to be dispensed), or intentionally (e.g., by a person who becomes frustrated with the results of a wager). Once the bezel is blocked, the slip being discharged from the printer has no where to go, resulting in a jam in the printer transport mechanism.

It would be advantageous to provide a bezel design that is resistant to jams when the bezel output opening is blocked. Such a design should provide reliable operation and enable easy recovery of the slip once the blockage is removed.

The present invention provides bezel designs having the aforementioned and other advantages.

SUMMARY OF THE INVENTION

In accordance with the present invention, an anti-jam bezel is provided for dispensing a flexible substrate. The bezel comprises a bezel body having an output slot. The output slot has a front portion for outputting the flexible substrate and a rear portion for receiving the flexible substrate from a transport. A guideway diverges away from the rear portion of the output slot toward the transport to provide a substrate receiving opening that can be wider than the front portion of the output slot. When in use, the bezel body is mounted adjacent the transport with a cavity between the transport and the guideway. The guideway, when mounted, is adapted to catch a leading edge of the substrate after the substrate exits the transport and guide the leading edge to the output slot. In the event the output slot is blocked, the guideway is adapted to guide at least a portion of the substrate into the cavity between the transport and the guideway, thereby preventing a jam.

In one illustrated embodiment, the guideway includes at least one projection extending from upper and lower edges of the rear portion of the output slot. More particularly, the guideway can include a series of upper fingers extending from an upper edge of the rear portion and a series of lower fingers extending from a lower edge of the rear portion. The upper and lower fingers are preferably designed to provide a V-shaped entrance to the guideway for catching the leading edge of the substrate. The cavity can be open in either a top section or a bottom section thereof to accommodate a loop in the substrate. Optionally, at least one drain hole can be provided within the cavity, e.g., in a bottom wall of the bezel body, to prevent liquid entering the output slot from entering said transport.

Depending on the specific implementation, the bezel body can be mounted on either the inside or outside of a terminal housing that contains the transport. Alternatively, the bezel body could be mounted on a door of a terminal that contains the transport. The flexible substrate could be, for example, one of a ticket, a receipt, a document, a check, a coupon or other suitable printed material.

A method is provided for preventing jams when dispensing a flexible substrate from an output slot. In accordance with the method, a bezel body having an output slot for dispensing the flexible substrate is provided. A leading edge of the substrate is caught in a guideway after the substrate exits a transport. The guideway extends from the bezel body toward the transport, and guides the leading edge of the substrate to the output slot. A space is provided between the guideway and the transport. At least a portion of the substrate is guided into the space in the event the output slot is blocked.

BRIEF DESCRIPTION OF THE DRAWINGS

For a further understanding of the present invention, reference will be made to the following detailed description of the invention which is to be read in association with the accompanying drawings, wherein.

DETAILED DESCRIPTION

Turning now to the drawings, there is illustrated a printer, generally referenced 10 and bezels generally referenced 20 and 70, which embody the teachings of the present invention. It is noted that the illustrated structures are only example embodiments that can incorporate the features of the present invention, and other embodiments are possible within the scope of the invention.

Figure 1:
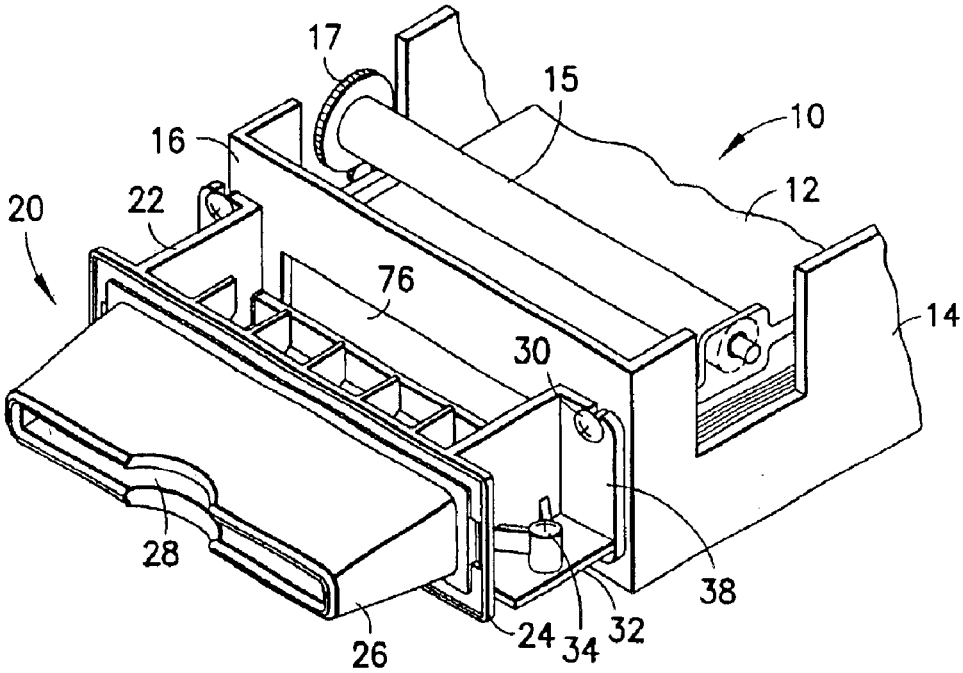
FIG. 1 is a perspective view of a first example embodiment of the invention, in which an internal bezel is shown mounted to a printer.

Referring to FIG. 1, a printer generally designated 10 includes a tray 14 that holds a stack of paper or other substrate to be printed. An example of such a printer is the Series 800, Model 850 thermal printer manufactured by TransAct Technologies Incorporated of Ithaca, N.Y., U.S.A., the assignee of the present application. The printer 10 includes a paper transport mechanism and a print mechanism (not shown) for printing and dispensing flexible substrates such as vouchers, coupons, tickets, receipts and the like ("slips") to consumers. One use of such printers is in gaming and lottery terminals to print and dispense slips such as paper tickets or vouchers having a cash value.

A terminal that includes such a printer will generally output the slip via a bezel. If the output slot of prior art style bezels is blocked, the printer transport will jam. In accordance with the present invention, new types of bezels are provided that are resistant to jams. One example of a jam resistant bezel in accordance with the invention is generally designated 20 in FIG. 1. In the embodiment of FIG. 1, bezel 20 comprises a bezel body that mounts directly to the front face 16 of printer 10 via rear flanges 38 and appropriate fasteners (e.g., bolts and nuts 30, 36). Pins 46 (FIG. 2) mate with corresponding holes in the front face 16 of the printer to ensure that the bezel is properly located on the printer. Side walls 22 of the bezel body extend between the rear flanges 38 and a front flange 24. A circuit board 32 is mounted under the side walls 22 via bolts 34. The circuit board can, for example, control various lights on the display panel of the terminal.

Figure 3A:
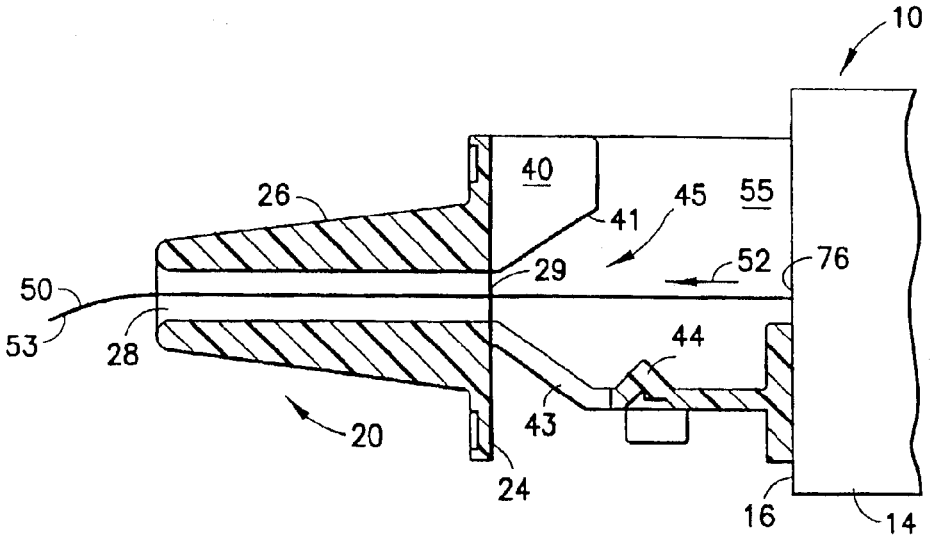
FIG. 3*a* is a cross sectional view of the bezel and printer assembly of FIG. 1 showing the dispensing of a substrate.

Bezel 20 includes an output slot 26 having a front portion 28 for outputting a slip and a rear portion 29 (FIG. 3*a*) for receiving the slip from a transport, such as the paper transport of printer 10. FIG. 1 shows roller 15, which is part of the paper transport of printer 10. Roller 15 is driven by a motor (not shown) via gear 17 to move the paper slip 12 through a print mechanism and out of the printer. As such paper transports are well known in the art, further details thereof are not shown the present drawings.

Figure 2:
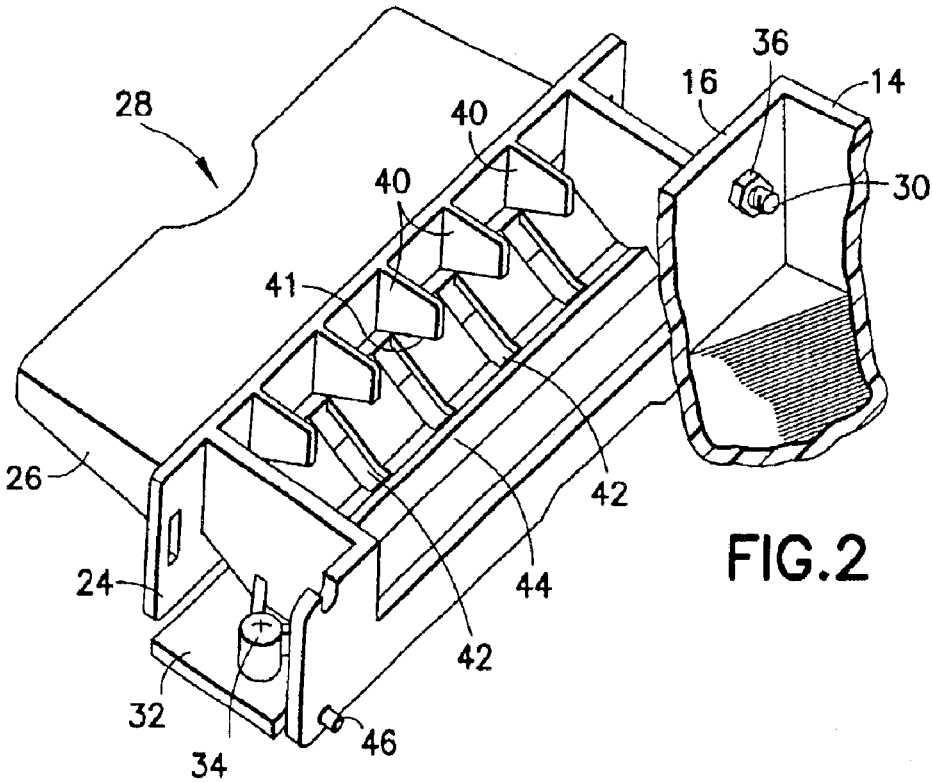
FIG. 2 is a top, rear and right side perspective view of the bezel shown in FIG. 1.

Bezel 20 has a guideway formed from ribs 40, which are tapered on the bottom edges 41 thereof to diverge away from the rear portion 29 of the output slot. In the embodiment of FIGS. 1 to 3, the bezel 20 also has a diverging bottom wall 43, which together with the ribs 40 forms a generally V-shaped opening 45 for receiving a substrate (e.g., a slip) from a printer. Since the V-shaped opening 45 is widest where it is closest to the printer 10, it will catch a leading edge 53 of the substrate 50, as the substrate leaves the exit slot 76 of the printer transport in the direction indicated by arrow 52. After catching the leading edge 53, the V-shaped opening will guide the leading edge to the bezel output slot 26 for output from the front portion 28 thereof.

Figure 3B:
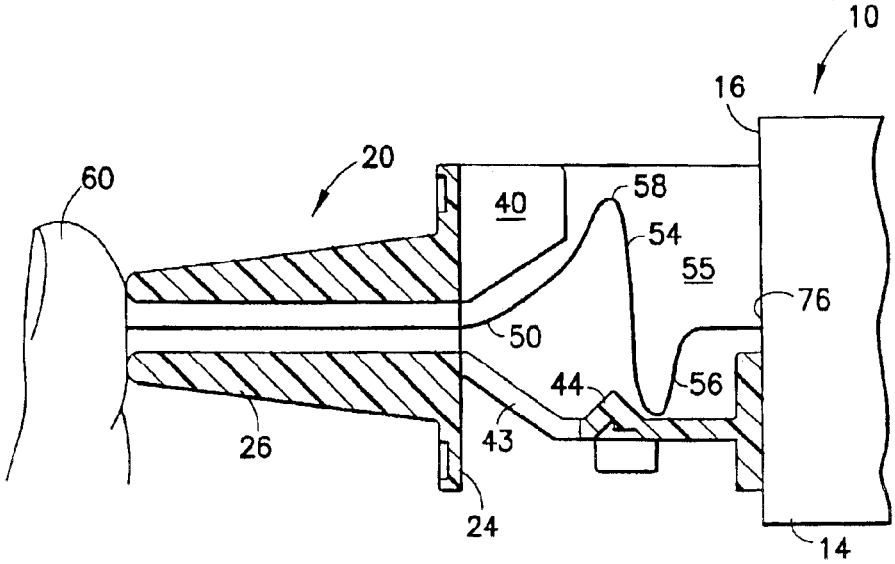
FIG. 3*b* is a cross sectional view of the bezel and printer assembly of FIG. 1 showing a blocked output opening.

The bezel 20 is designed such that it has a cavity 55 situated between the paper transport (printer 10) and the rear portion 29 of the output slot 26. In the event that the front portion 28 of the output slot 26 is blocked, e.g., by a person's finger as shown in FIG. 3*b* when a substrate 50 is trying to exit from the bezel, the V-shaped opening will guide the blocked substrate 50 into the cavity 55 to prevent a paper jam from occurring in the paper transport. In particular, if the leading edge 53 of the substrate is blocked as it tries to exit from the bezel, the ribs 40 or the bottom wall 43 (depending on which way the substrate curls) will assist the substrate 50 in forming a loop 58, 54, 56 within the cavity. A director strip 44, which may be triangular in shape, can also be provided to facilitate the looping of the substrate. In the event that the loop commences along the ribs 40 as shown in FIG. 3*b*, the slope of the director strip 44 closest to the printer will assist in the formation of the loop portion 56. Conversely, if the loop commences along the bottom wall 43, the slope of the director slip 44 closest to the output slot 26 will urge the substrate to loop toward the top of the cavity 55 in the direction of the printer. By providing space for the loop to form, the cavity allows the substrate to be entirely ejected from the transport without causing a jam in the printer.

Another feature of the bezel 20 of FIGS. 1–3 is that it includes openings 42 within the bottom wall 43. These openings are provided for the drainage of liquid. In the event that a disgruntled customer pours coffee or another beverage, for example, into the output slot 26, the openings will drain the liquid prior to reaching the printer. Thus, the printer will be protected from damage that could otherwise result if liquid were to enter the printer exit slot 76.

The bezel body that forms the bezel 20 can be fabricated of any suitable material, such as plastic. The angle at which the guideway formed from ribs 40 and bottom wall 43 diverges from the rear portion 29 of output slot 26 is preferably in a range of about 45° to about 75°, although angles outside this range may also be appropriate. In the specific embodiment shown in the drawings, the angle between the bottom edges 41 and the bottom wall 43 is about 60°.

Figure 4:
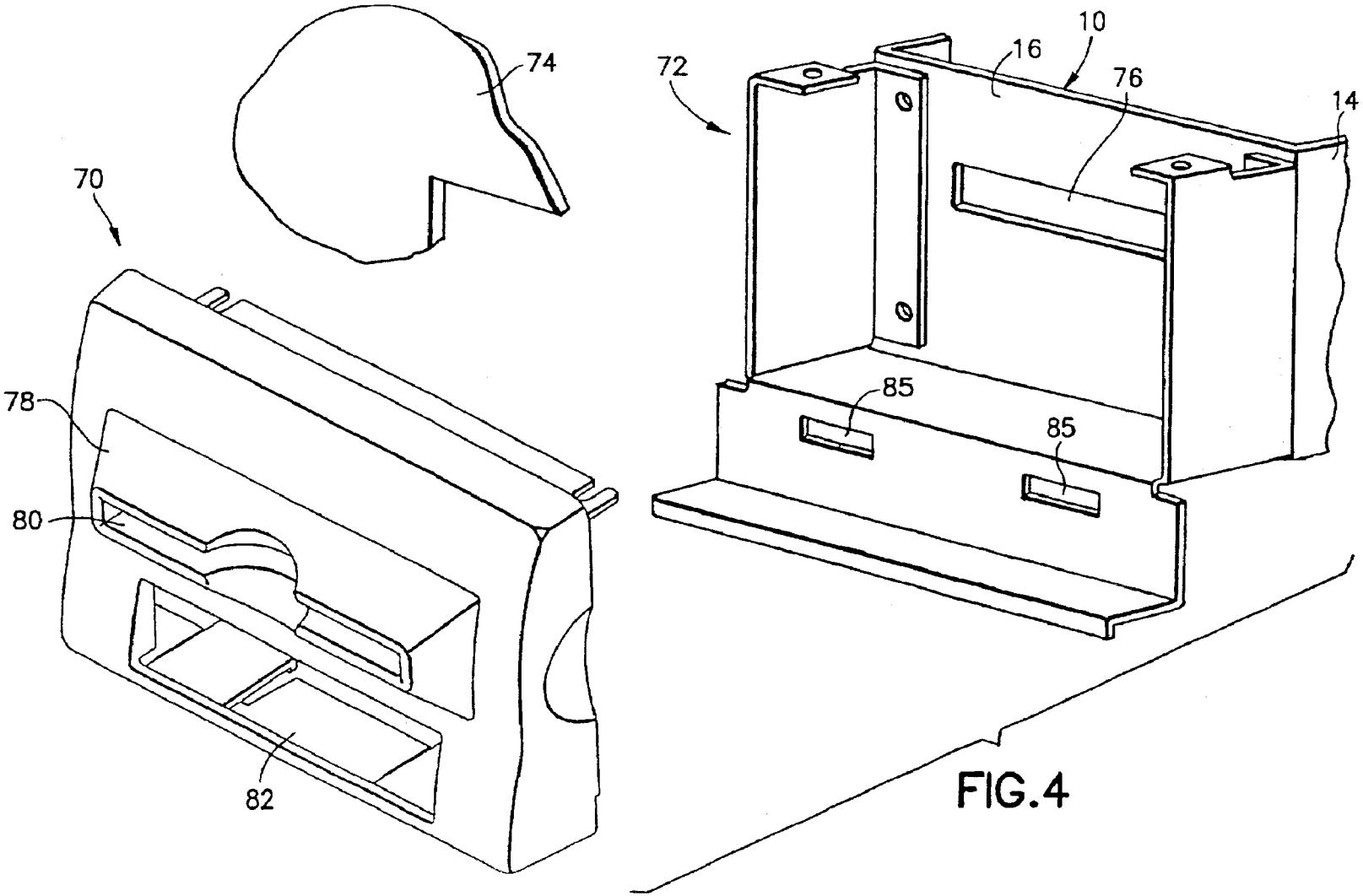
FIG. 4 is an exploded perspective view of a second example embodiment of the invention, in which an external bezel can be mounted over a front panel to a printer via a mounting bracket.
Figure 5:
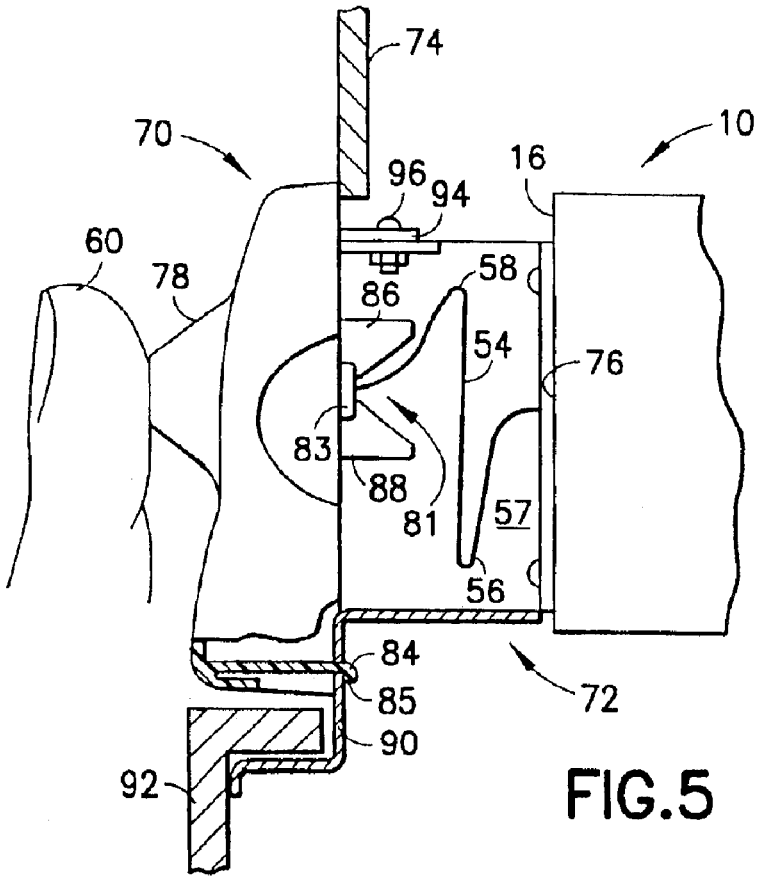
FIG. 5 is a cross sectional view of the bezel of FIG. 4 when mounted via the bracket to the printer, showing a blocked output opening.
Figure 6:
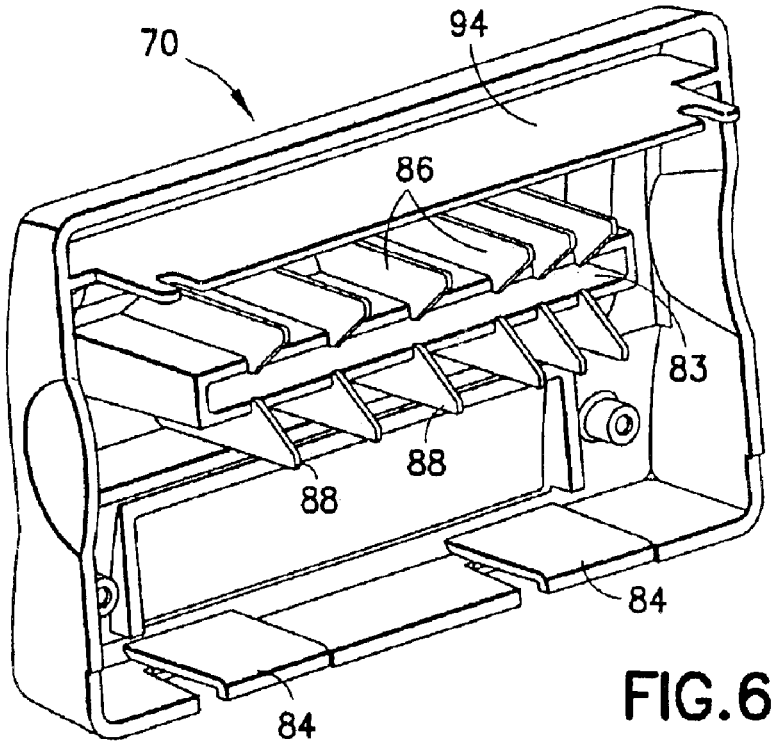
FIG. 6 is a top, rear and right side perspective view of the bezel shown in FIG. 4.

FIGS. 4–6 illustrate another embodiment, in which a bezel generally designated 70 is mounted external to the front panel 74 of a wagering terminal or the like. The bezel 70 includes an output slot 78 with a front opening 80 through which a slip is dispensed. An opening 82 is provided for mounting a lens that is backlit to illuminate a "retrieve ticket" indicia or the like.

The bezel 70 mounts to a mounting bracket generally designated 72 which, in turn, mounts to the front wall 16 of printer 10. As can be seen in FIG. 5, the bezel can be mounted to the bracket 72 via bezel mounting wall 94 using any suitable fastener, such as a bolt 96. Resilient clips 84 can also be provided on the bezel to hook over corresponding slots 85 in the bracket. The front of the bracket can include a portion 90 that provides a channel for accepting the top edge of a door 92 used to gain access to the inside of the terminal. The bracket dimensions provide a cavity 57 between the printer 10 and the bezel 70. In the illustrated embodiment, the bezel is fabricated from plastic and the bracket is metal. It should be appreciated, however, that other satisfactory materials can be substituted.

The back of bezel 70 has top fingers 86 and bottom fingers 88 extending therefrom toward a transport included in printer 10. The fingers form a V-shaped guideway 81 to catch the leading edge of a slip exiting the printer exit opening 76. The guideway also serves to guide the slip into the rear portion 83 of the bezel output slot 78 for dispensing from the front portion 80 of the slot.

In the event the bezel output slot is blocked, for example by a customer's finger 60, the cavity 57 provides a space for the slip to form into a loop 56, 54, 58. The angled portions of fingers 86 and 88, which extend behind the rear portion 83 of the bezel output slot and form the aforementioned V-shaped guideway, assist in the formation of the loop by urging the blocked slip in an upward or downward direction as the transport continues to push the slip in the direction of the output slot. By allowing the loop to form, the slip can exit the printer 10 via slot 76 without jamming in the printer transport.

As with the embodiment of FIGS. 1–3, the angle formed between fingers 86 and 88 (which results in the V-shaped opening) can be on the order of about 45° to about 75°, although angles outside this range may also be appropriate.

In the specific embodiment shown in the drawings, the angle between the sloped fingers is about 60°.

It should now be appreciated that the present invention provides bezel structures that enable a slip to exit a printer without jamming, even if the bezel output slot is blocked.

A guideway is provided at the back of the bezel for catching the leading edge of a slip to be dispensed, and guiding the slip to an output slot. The guideway is constructed such that it cooperates with a cavity between the output slot and the printer, to enable a slip to loop within the cavity upon blockage of the output slot. Since the cavity provides a place for the slip to go, the slip can exit the printer without jamming.

While the present invention has been particularly shown and described with reference to various preferred modes as illustrated in the drawings, it will be understood by those skilled in the art that various changes in detail may be effected therein without departing from the spirit and scope of the invention as defined by the claims.

I claim:

1. An anti-jam bezel for dispensing a flexible substrate, comprising:

a bezel body;

an output slot in said bezel body, said output slot having a front portion for outputting said flexible substrate and a rear portion for receiving said flexible substrate from a final output transport which provides said substrate to said rear portion of said output slot; and a guideway connected to and diverging away from said rear portion of said output slot to form a substrate receiving opening for receiving the substrate provided by the transport;

wherein:

when said bezel body is mounted on said transport a cavity is formed in the space between the transport and said rear portion;

said guideway catches a leading edge of said substrate received from the transport and guides said leading edge to said output slot; and in the event said output slot is blocked, said guideway causes at least a portion of said substrate to loop into said cavity.

2. A bezel in accordance with claim 1, wherein said guideway comprises at least one projection extending from upper and lower edges of the rear portion.

3. A bezel in accordance with claim 1, wherein said guideway comprises a series of upper fingers extending from an upper edge of the rear portion and a series of lower fingers extending from a lower edge of the rear portion.

4. A bezel in accordance with claim 3 wherein said upper and lower fingers provide a V-shaped entrance to said guideway for catching said leading edge.

5. A bezel in accordance with claim 1 wherein said cavity is open at one of a top or a bottom thereof.

6. A bezel in accordance with claim 1, wherein at least one opening is provided at a bottom portion of said cavity to permit drainage of liquid introduced into said output slot.

7. A bezel in accordance with claim 1, further comprising at least one drain hole in said bezel body to prevent liquid entering said output slot from entering said transport.

8. A bezel in accordance with claim 1, wherein said bezel body is mounted on the inside of a terminal housing that contains said transport.

9. A bezel in accordance with claim 1, wherein said bezel body is mounted on the outside of a terminal housing that contains said transport.

10. A bezel in accordance with claim 1, wherein said bezel body is mounted on a door of a terminal that contains said transport.

11. A bezel in accordance with claim 1, wherein said flexible substrate comprises one of a ticket, a receipt, a document, a check, or a coupon.

12. A method for preventing jams when dispensing a flexible substrate from an output slot, comprising the steps of:

providing a bezel body having an output slot for dispensing said flexible substrate, said output slot having a front portion for outputting said flexible substrate and a rear portion for receiving said flexible substrate from a final output transport, said final output transport providing said flexible substrate to said rear portion of said output slot;

catching a leading edge of said substrate in a guideway connecting to and diverging away from said rear portion toward said final output transport after the substrate exits the transport;

guiding said leading edge to the output slot via said guideway;

forming a cavity in the space between the guideway and said transport; and guiding at least a portion of said substrate into said cavity, said guideway causing said at least a portion of said substrate to loop into said cavity in the event said output slot is blocked.

13. A method in accordance with claim 12, wherein said guideway comprises at least one projection extending from upper and lower edges of the rear portion.

14. A method in accordance with claim 12, wherein said guideway comprises a series of upper fingers extending from an upper edge of the rear portion and a series of lower fingers extending from a lower edge of the rear portion.

15. A method in accordance with claim 14 wherein said upper and lower fingers provide a V-shaped entrance to said guideway for catching said leading edge.

16. A method in accordance with claim 12 wherein said cavity is open at one of a top or a bottom thereof.

17. A method in accordance with claim 12, further comprising:

providing at least one opening at a bottom portion of said cavity to permit drainage of liquid introduced into said output slot.

18. A method in accordance with claim 12, wherein said bezel body is mounted on the inside of a terminal housing that contains said transport.

19. A method in accordance with claim 12, wherein said bezel body is mounted on the outside of a terminal housing that contains said transport.

20. A method in accordance with claim 12, wherein said bezel body is mounted on a door of a terminal that contains said transport.

21. A method in accordance with claim 12, wherein said flexible substrate comprises one of a ticket, a receipt, a document, a check, or a coupon.

* * * * *